US010174647B2

(12) United States Patent
Jang et al.

(10) Patent No.: US 10,174,647 B2
(45) Date of Patent: Jan. 8, 2019

(54) OIL DRAIN STRUCTURE OF VALVE TIMING ADJUSTING DEVICE FOR INTERNAL COMBUSTION ENGINE

(71) Applicants: HYUNDAI MOTOR COMPANY, Seoul (KR); KIA Motors Corporation, Seoul (KR); Delphi Powertrain Systems Korea Ltd., Changwon-si, Gyeongsangnam-do (KR); Pine Engineering Ltd., Changwon-si, Gyeongsangnam-do (KR)

(72) Inventors: Koun Young Jang, Changwon-si (KR); Sung Dae Kim, Changwon-si (KR); Sang Ho Lee, Changwon-si (KR); Jae Young Kang, Changwon-si (KR); Sung Hoon Baek, Gimhae-si (KR); Soo Deok Ahn, Changwon-si (KR); Chung Han Oh, Seongnam-si (KR); YoungSam Gu, Yongin-si (KR); Min Su Park, Uiwang-si (KR); Jae Gyu Lee, Hwaseong-si (KR)

(73) Assignees: HYUNDAI MOTOR COMPANY, Seoul (KR); KIA MOTORS CORPORATION, Seoul (KR); DELPHI POWERTRAIN SYSTEMS KOREA LTD., Changwon-si, Gyeongsangnam-Do (KR); PINE ENGINEERING LTD., Changwon-si, Gyeongsangnam-Do (KR)

( * ) Notice: Subject to any disclaimer, the term of this patent is extended or adjusted under 35 U.S.C. 154(b) by 70 days.

(21) Appl. No.: 15/449,290

(22) Filed: Mar. 3, 2017

(65) Prior Publication Data

US 2017/0204749 A1 Jul. 20, 2017

(30) Foreign Application Priority Data

Jan. 6, 2016 (KR) ..... 10-2016-0001689

(51) Int. Cl.
*F01L 1/34* (2006.01)
*F01L 1/047* (2006.01)
*F01L 1/344* (2006.01)

(52) U.S. Cl.
CPC ..... *F01L 1/3442* (2013.01); *F01L 1/047* (2013.01); *F01L 1/34409* (2013.01); (Continued)

(58) Field of Classification Search
CPC ..... F01L 1/3442; F01L 1/34409; F01L 1/047; F01L 2250/04; F01L 2250/02; (Continued)

(56) References Cited

U.S. PATENT DOCUMENTS 6,276,322 B1 * 8/2001 Sekiya ..... F01L 1/3442 123/90.17
2012/0000437 A1 * 1/2012 Ozawa ..... F01L 1/3442 123/90.15
2013/0180481 A1 * 7/2013 Kato ..... F01L 1/34 123/90.15

FOREIGN PATENT DOCUMENTS

JP 09-324613 A 12/1997
JP 11-062521 A 3/1999
(Continued)

*Primary Examiner* — Mark A Laurenzi
*Assistant Examiner* — Wesley G Harris
(74) *Attorney, Agent, or Firm* — Brinks Gilson & Lione

(57) ABSTRACT

An oil drain structure of a valve timing adjusting device for an internal combustion engine is provided to adjust a valve timing of at least one of an intake valve and an exhaust valve by a torque of a cam shaft and a pressure of a working fluid. The oil drain structure of the valve timing adjusting device includes a rotation preventing means to suppress a position change between a rotor and a housing by regulating a relative rotation of the rotor with respect to the housing.

7 Claims, 6 Drawing Sheets

(52) U.S. Cl.
CPC ..... *F01L 2001/3443* (2013.01); *F01L 2001/34433* (2013.01); *F01L 2001/34459* (2013.01); *F01L 2001/34463* (2013.01); *F01L 2001/34469* (2013.01); *F01L 2250/02* (2013.01); *F01L 2250/04* (2013.01)

(58) Field of Classification Search
CPC ... F01L 2001/34469; F01L 2001/34463; F01L 2001/3443; F01L 2001/34433; F01L 2001/34459
See application file for complete search history.

(56) References Cited

FOREIGN PATENT DOCUMENTS

| | | | |
|---|---|---|---|
| JP | 2000-002104 | A | 1/2000 |
| JP | 2000-179310 | A | 6/2000 |
| JP | 2001-050016 | A | 2/2001 |
| JP | 2010-285986 | A | 12/2010 |
| JP | 2012-057487 | A | 3/2012 |
| JP | 2013-155612 | A | 8/2013 |
| JP | 2002-357105 | A | 12/2013 |
| KR | 10-2010-0132923 | A | 12/2010 |
| KR | 10-2012-0032510 | | 4/2012 |

* cited by examiner

OIL DRAIN STRUCTURE OF VALVE TIMING ADJUSTING DEVICE FOR INTERNAL COMBUSTION ENGINE

CROSS REFERENCE TO RELATED APPLICATION

The present application claims priority to and the benefit of Korean Patent Application No. 10-2016-0001689, filed on Jan. 6, 2016, which is incorporated herein by reference in its entirety.

FIELD

The present disclosure relates to a valve timing adjusting device for an internal combustion engine, and more particularly, to an oil drain structure of a valve timing adjusting device for an internal combustion engine.

BACKGROUND

The statements in this section merely provide background information related to the present disclosure and may not constitute prior art.

Generally, an internal combustion engine (hereafter, referred to as an "engine") is equipped with a valve timing adjustment apparatus that can change timing of intake valves and discharge valves (e.g., exhaust valves), depending on the operation state of the engine. Such a valve timing adjustment apparatus adjusts the timing of intake valves or exhaust valves by changing a phase angle according to the displacement or rotation of the camshaft connected to the crankshaft via a timing belt or chain.

In general, a vane type valve timing adjustment apparatus that includes a rotor having a plurality of vanes freely rotated by working fluid in a housing is generally used.

The vane type valve timing adjustment apparatus adjusts valve timing between a full advance phase angle and a full retard phase angle by using a difference in rotational phase generated due to relative rotation in an advance direction or a retard direction of a rotor that is rotated through vanes operated by the pressure of working fluid supplied to an advance chamber or a retard chamber. In an emergency situation or engine stop condition, the rotation of the cam shaft and crank shaft is synchronized by locking the rotor at a specific position via a locking pin.

We have discovered that a positive torque is generated by friction due to rotation of a cam in opposite direction to the rotational direction of the cam. Meanwhile, a negative torque is generated by restoring force of a valve spring in the same direction as the rotational direction of the cam when a valve starts closing, and the negative force is smaller than the positive torque.

SUMMARY

The present disclosure provides an oil drain structure of a valve timing adjusting device for an internal combustion engine capable of smoothly and certainly performing a phase adjustment or a locking operation to improve reliability and having a simple structure to reduce a design burden and reduce manufacturing costs.

In one form of the present disclosure, there is provided an oil drain structure of a valve timing adjusting device between a crank shaft and a cam shaft of an internal combustion engine, the oil drain structure including: a housing coupled with a ratchet plate interlocking with the crank shaft and having an inner space; a rotor configured to partition an inner space of the housing into an advance chamber and a retard chamber while interlocking with the cam shaft, the rotor having a plurality of vanes relatively rotating in the advance chamber and the retard chamber with respect to the housing by the pressure of the working fluid to adjust a phase; and a rotation preventing means configured to suppress a position change between the rotor and the housing by regulating the relative rotation of the rotor with respect to the housing. In particular, the rotation preventing means includes: a locking member elastically installed in a mounting hole of at least one of the vanes; a plurality of locking grooves connected to each other at different depth on a surface of a ratchet plate so that the plurality of locking grooves are coupled with a locking pin member during a locking operation of the locking pin member; a drain groove connected to at least one locking groove of the plurality of locking grooves and configured to discharge the working fluid within the at least one locking groove during the locking operation; and a drain hole formed in the rotor and configured to communicate with the drain groove.

The locking pin member may further include an upper cap configured to close one end portion of the mounting hole.

The locking pin member may include an outer pin elastically installed against the upper cap and an inner pin elastically installed in the outer pin against the upper cap.

The outer pin may have a structure in which an outer circumferential portion of an upper portion thereof is divided into a step-shaped extension and a cylindrical part having a flange part coupled with a lower edge of the step-shaped extension.

The drain hole may be positioned to be adjacent to an inner circumferential surface of the housing at an outside of the mounting hole of the at least one of the vanes.

The drain groove may include a first drain groove extending in a radial direction of the rotor and a second drain groove extending in a circumferential direction of the rotor and being connected to the first drain groove, the second drain groove configured to be selectively blocked from or communicate with the drain hole.

The first and second drain grooves may be positioned to be biased in an advance direction with respect to a central line of the at least one locking groove of the plurality of locking grooves.

The locking pin member may further include a lower cap configured to support an outer circumferential surface of an outer pin, the lower cap positioned at another end portion of the mounting hole.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
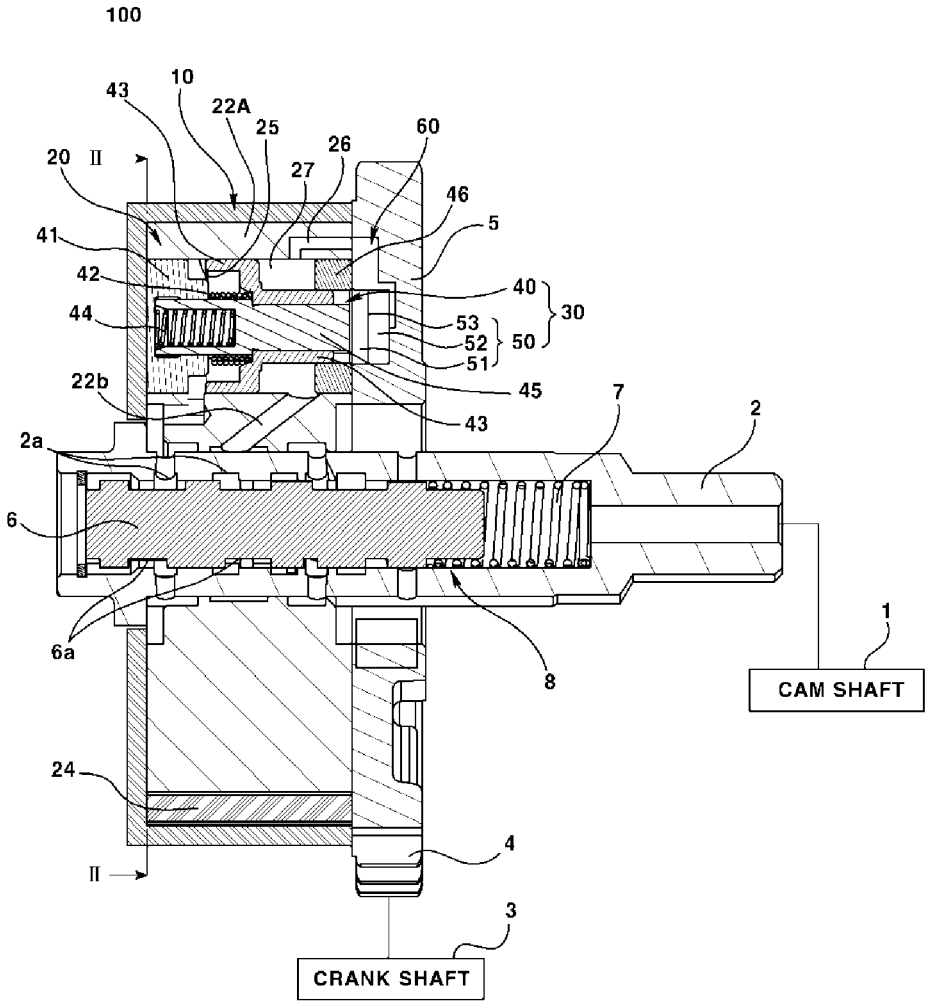
FIG. 1 is an assembling cross-sectional view of a valve timing adjusting device along the line I-I of FIG. 2.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, a valve timing adjusting device for an internal combustion engine, as an exemplary form of the present disclosure, will be described in detail with reference to the accompanying drawings.

FIG. 1 is an assembling cross-sectional view of a valve timing adjusting device 100 in one exemplary form of the present disclosure.

Figure 2:
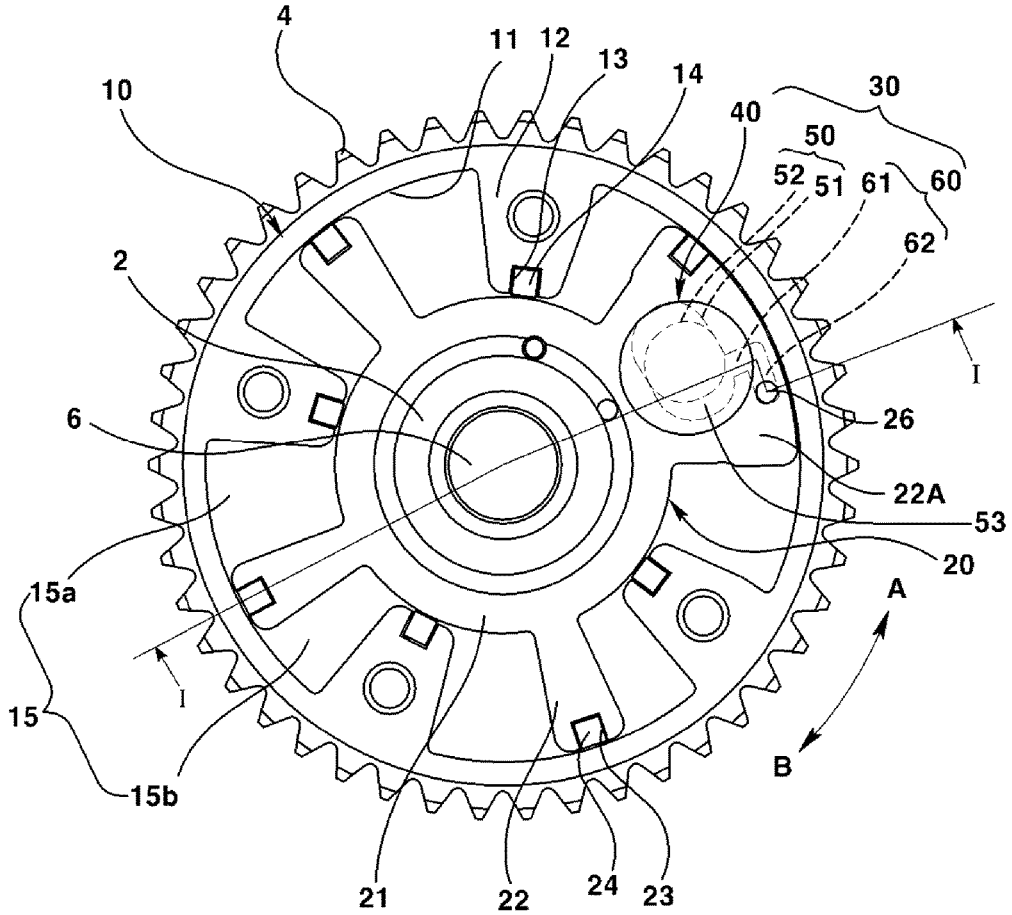
FIG. 2 is a front view taken along the line II-II of FIG. 1.

Referring to FIGS. 1 and 2, in the valve timing adjusting device 100, a body 2 connected to a cam shaft 1 of an internal combustion engine is formed to be extended, a sprocket 4 that is connected to a crank shaft 3 by a chain or a timing belt (not illustrated) is rotatably coupled with an outer circumference of the body 2, and a disk-shaped ratchet plate 5 is integrally formed inside of the sprocket 4.

The body 2 interlocking with the cam shaft 1 makes up a solenoid valve 8 that switches a flow of working fluid and controls the flow while a spool 6 having a plurality of oil grooves 6*a* formed on an outer circumferential surface thereof is elastically installed by a spring 7 and thus selectively communicates with a plurality of oil ports 2*a* formed on an outer circumference of the body 2 according to a control signal of a controller (not illustrated).

Meanwhile, the body 2 is coupled with a cylindrical housing 10, a rotor 20 coupled to be relatively rotated within an inner space of the housing 10 while interlocking with the cam shaft, and a rotation preventing means 30 regulating a relative rotation of the rotor 20 with respect to the housing 10.

A plurality of protrusions 12 are protrudedly formed on an inner circumferential surface 11 of the housing 10 at a predetermined interval. Upper ends of each protrusion 12 are formed with sealing grooves 13 in a length direction of the housing 10 and thus sealing seals 14 are each inserted into the sealing grooves 13 to form spaces 15 between adjacent protrusions 12.

Meanwhile, as illustrated in FIG. 2, in the rotor 20, a plurality of vanes 22 are formed at a boss part 21 coupled with the body 2 to protrude toward an inner circumferential surface 11 of the housing 10. Upper ends of each vane 12 are formed with sealing grooves 23 in a length direction of the rotor 20 and thus sealing seals 24 are each inserted into the sealing grooves 23 to form the spaces 15 between the adjacent protrusions 12 of the housing 10.

The space 15 is partitioned into a retard chamber 15*a* in an arrow B direction (that is, advance direction) that is a rotating direction of the cam shaft 1 and an advance chamber 15*b* in an arrow A direction (that is, retard direction), with respect to the vane 12 as illustrated in FIG. 2.

Therefore, the working fluid is selectively supplied to the retard chamber 15*a* and the advance chamber 15*b* and thus a torque applied to the vane 12 adjusts an advance phase while the rotor 20 rotates in the arrow B direction (advance direction) with respect to the housing 10 or to the contrary, adjusts a retard phase while the rotor rotates in the arrow A direction (retard direction), thereby adjusting valve timing of an intake valve or an exhaust valve.

Meanwhile, the rotation preventing means 30 is provided to inhibit or prevent the relative rotation of the rotor 20 to the housing 10.

The rotation preventing means 30 may be installed at any one of the vanes 12 as illustrated in FIG. 2. Here, for convenience of explanation, the vane 22 provided with the rotation preventing means 30 is denoted by reference numeral 22A to be differentiated from other vane 22.

As illustrated in FIG. 1, the rotation preventing means 30 may include a locking pin member 40 inserted into a mounting hole 25 formed to penetrate through the vane 22A, a plurality of locking grooves 50 formed on a ratchet plate 5 to be operated in the locked state or release the locked state while being coupled with the locking pin member 40, and drain grooves 60 connected to the locking grooves 50 to discharge the working fluid of the locking grooves 50.

In one form, a drain hole 26 is formed at the vane 22A so that the drain hole 26 communicates with the drain groove 60. As illustrated in FIG. 2, the drain hole 26 may be positioned to be adjacent to an inner circumferential surface 11 of the housing 10 at the outside of the mounting hole 25 of the vane 22A.

Here, as illustrated in FIG. 1, the locking pin member 40 includes an upper cap 41 closing one end portion (left end portion in FIG. 1) of the mounting hole 25 of the vane 22A, a hollow cylindrical outer pin 43 elastically installed at a lower end portion of the upper cap 41 by an outer spring 42, and an inner pin 45 elastically installed against the upper cap 41 by an inner spring 44 while being slidably coupled with an inside of the outer pin 43.

Further, the locking pin member 40 may additionally include a ring-shaped lower cap 46 supporting an outer circumferential surface of the outer pin 43 while being positioned at the other end portion (right end portion in FIG. 1) of the mounting hole 25.

Meanwhile, as illustrated in FIGS. 1 and 2, the plurality of locking grooves 50 formed on the ratchet plate 5 configuring the rotation preventing means 30 may be formed to be connected to each other at different diameters and different depths while facing the mounting hole 25 of the vane 22. That is, the locking groove 50 includes a large diameter groove 51 and a small diameter groove 52, in which the large diameter groove 51 and the small diameter groove 52 are connected to each other while forming a stepped part 53 of which the cross section has a step shape.

Further, as illustrated in FIG. 2, the drain groove 60 may include a first drain groove 61 extending in a radial direction of the rotor 20 while being connected to one side of the locking groove 50 and a second drain groove 62 extending in a circumferential direction of the rotor 20 while being connected to the first drain groove 61 and being selectively blocked from or communicating with the drain hole 26.

The first drain groove 61 may be formed in one or plural in substantially a vertical direction to the large diameter groove 51 or the small diameter groove 52 but the present disclosure is not limited thereto. For example, the first drain groove 61 may be inclinedly connected to the large diameter groove 51 or the small diameter groove 52.

Further, FIG. 2 illustrates that the second drain groove 62 extends in the circumferential direction of the rotor 20 while being substantially vertically connected to the first drain groove 61 but the present disclosure is not limited thereto. That is, the second drain groove 62 may also be inclinedly connected to the first drain groove 61, having a predetermined angle with the first drain groove 61.

The first and second drain grooves 61 and 62 may be positioned to be biased in the advance direction with respect to the central line of the locking groove 50. However, the present disclosure is not limited thereto and the first and second drain grooves 61 and 62 may also be positioned to be biased in the retard direction (B direction) with respect to the locking groove 50.

Meanwhile, an oil passage 22*b* through which the working fluid is supplied from the mounting hole 25 to a space 27 around the outer pin 43 and is discharged is inclinedly formed on the vane 22A of the rotor 20 to penetrate through the vane 22A so that the oil passage 22*b* communicates with the solenoid valve 8.

The drain hole 26 is communicated to the space 27 so that the working fluid from the locking groove 50 is able to be discharged through the oil passage 22*b*.

Next, the operation of the locking structure of the valve timing device according to the exemplary form of the present disclosure will be described.

When the engine is normally operated, the rotor 20 may adjust the valve timing of the intake valve or the exhaust valve through the cam shaft 1 while freely performing the phase adjustment operation in the advance direction (direction B) or the retard direction (direction A) with respect to the housing 10 depending on the torque transferred from the cam shaft 1 while forming the retard chamber 15*a* and the advance chamber 15*b* at the left and right in the space 15 between protrusions 12 adjacent to the vane 22A.

Figure 3A:
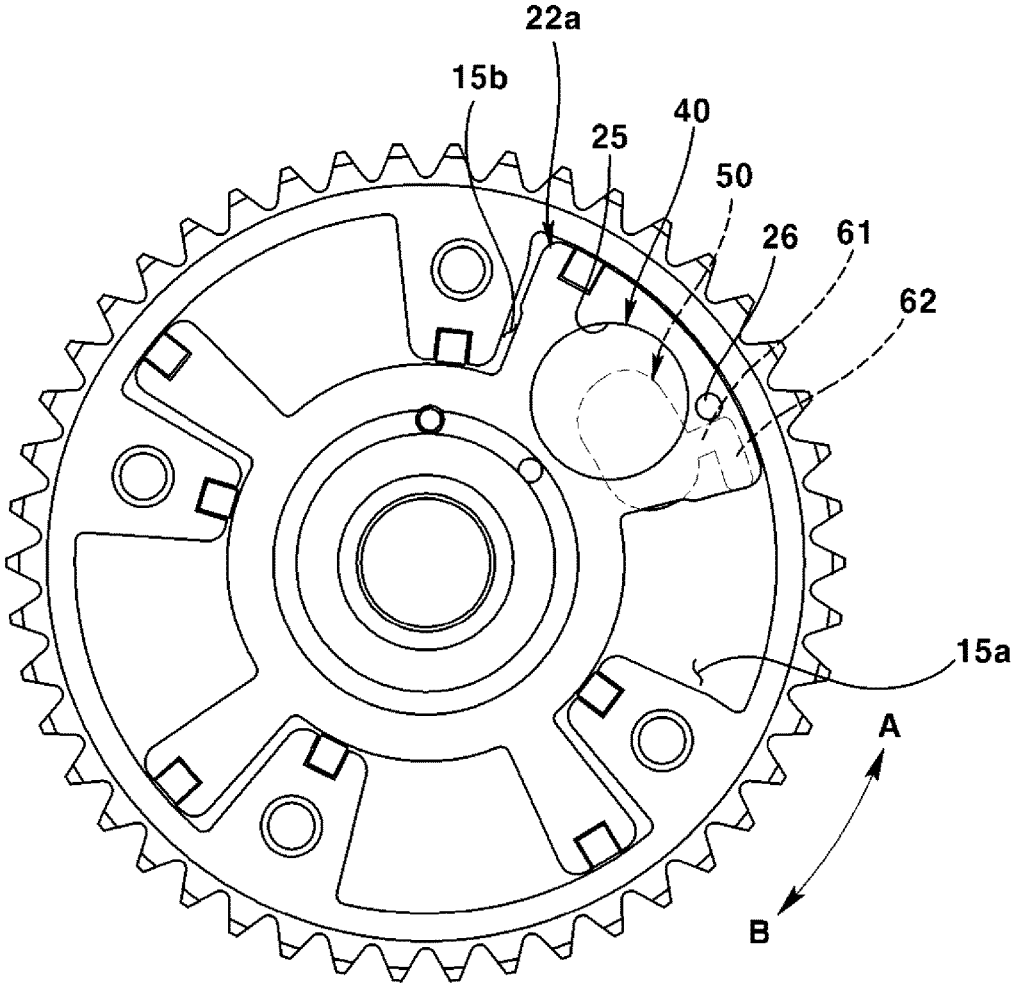
FIGS. 3A to 3C are front cross-sectional views of FIG. 1, illustrating a communication relationship between drain grooves when a locking pin member is operated.

FIG. 3A illustrates the state in which the phase adjustment operation is performed in the state in which the vane 22A provided with the locking pin member 40 is biased toward the retard direction, that is, the advanced chamber 15*b* with respect to the locking groove 50. In this case, the locking pin member 40 including the outer pin 43 and the inner pin 45 is partially over the locking groove 50, but the second drain groove 62 does not communicate with the drain hole 26 of the vane 22A but is blocked and the pressure fluid within the locking groove 50 is not discharged.

Therefore, the rotor 20 adjusts the valve timing while freely performing the phase adjustment operation in the advance direction (direction B) or the retard direction (direction A) with respect to the housing 10, depending on the torque transferred from the cam shaft 1.

The section in which the drain groove 60 communicates with the drain hole 26 is occurred during the phase adjustment operation. In this case, if the working fluid is supplied to the space 27 through the oil passage 22*b*, the locking pin member 40 is released from the locking groove 50 and the released state is maintained, and the phase adjustment operation of the rotor 20 is normally performed smoothly even though the drain groove 60 communicates with the drain hole 26. Meanwhile, the valve timing adjusting device is operated at the preset position without a separate control when the engine starts to improve startability or when the emergency situation of the control impossibility occurs while the engine is driven, the locking pin member 40 is self-locked without the separate control to inhibit or prevent the relative rotation of the rotor 20 with respect to the housing 10.

Figure 3B:
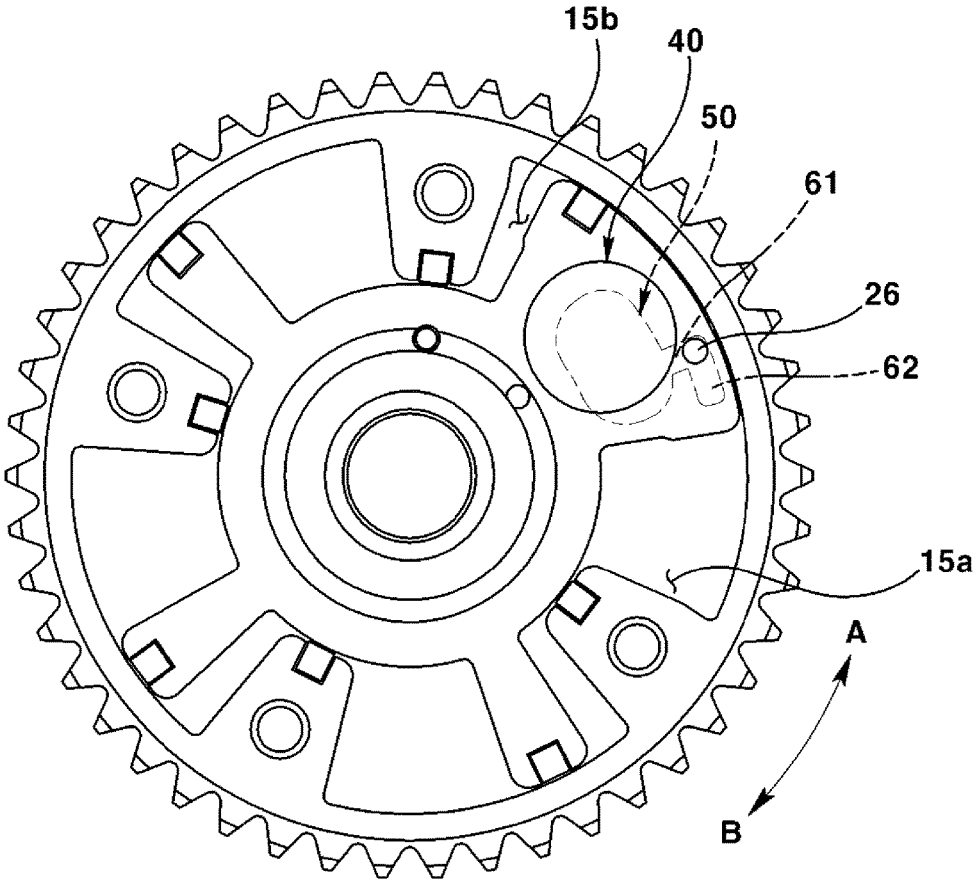

For example, if as illustrated in FIG. 3A, the phase adjustment operation is performed in the state in which the vane 22A provided with the locking pin member 40 is biased toward the advance chamber 15*b* and then the negative torque is transferred from the cam shaft 1, the locking pin members 40 sequentially rotate in the direction B to enter the locking grooves 50 to be locked, as illustrated in FIG. 3B.

That is, the drain hole 26 of the vane 22A communicates with the drain groove 60 while the locking pin members 40 including the outer pin 43 and the inner pin 45 sequentially enter the locking grooves 50. Therefore, the pressure fluid within the locking groove 50 is moved to the space 27 through the drain groove 60 and the drain hole 26 and then discharged to the outside through the oil passage 22*b*, and therefore the locking operation of the locking pin member 40 is smoothly performed.

Meanwhile, to release the locked state of the rotor 20, if the working fluid is introduced into the space 27 through the oil passage 22*b* formed to penetrate through the vane 22A, the outer pin 43 and the inner pin 45 move to the upper cap 41 while compressing the outer spring 42 and the inner spring 44 by the pressure of the working fluid. Therefore, the rotor 20 adjusts the valve timing of the intake valve or the exhaust valve while freely performing the phase adjustment operation in the advance direction (direction B) or the retard direction (direction A) with respect to the housing 10, depending on the torque transferred from the cam shaft 1.

The section in which the drain groove 60 communicates with the drain hole 26 may be occurred during the phase adjustment operation. In this case, if the working fluid is supplied to the space 27 through the oil passage 22*b* to release the locked state of the locking pin member 40 and maintain the released state thereof and therefore the phase adjustment operation of the rotor 20 is normally performed smoothly even though the drain groove 60 communicates with the drain hole 26.

Figure 3C:
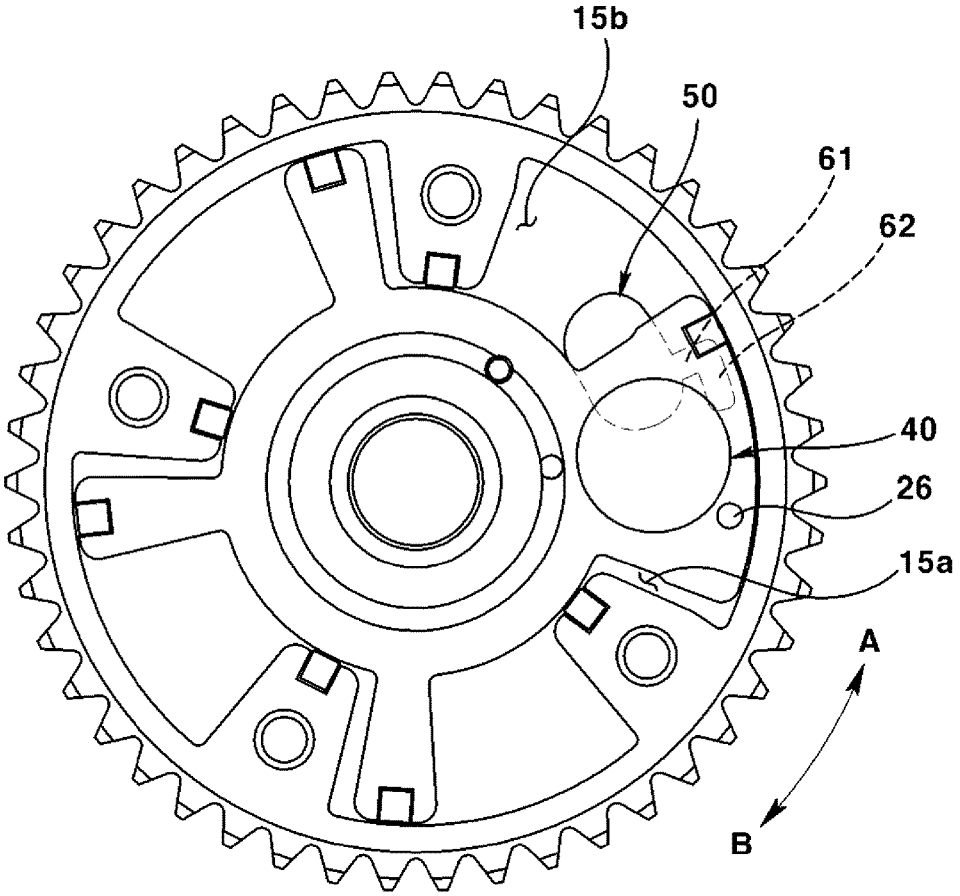

FIG. 3C illustrates the state in which the phase adjustment operation is performed in the state in which the vane 22A provided with the locking pin member 40 is biased toward the advance direction, that is, the retard chamber 15*a* with respect to the locking groove 50. Like FIG. 3A, though the locking pin member 40 is partially over the locking groove 50, the drain hole 26 does not communicate with the drain groove 60 and the pressure fluid within the locking groove 50 is not discharged.

The rotor 20 adjusts the valve timing while freely performing the phase adjustment operation in the advance direction (direction B) or the retard direction (direction A) with respect to the housing 10, depending on the torque transferred from the cam shaft 1.

In one form of the present disclosure as described above, the drain groove 60 of the ratchet plate 5 and the drain hole 26 of the rotor 20 are blocked at the time of the phase adjustment operation of the locking pin member 40 and communicate with each other at the time of the locking to discharge the working fluid of the locking groove 50 to the outside, such that the locking operation of the locking pin member 40 may be smoothly and certainly performed, thereby improving the reliability and making the structure simple to reduce the design burden of the components and reduce manufacturing costs.

The above description relates to the exemplary forms of the present disclosure and does not limit the present disclosure. It is to be understood by those skilled in the art that the present disclosure may be variously changed and modified without departing from the scope of the present disclosure.

For example, the exemplary form of the present disclosure describes that the rotor 20 is provided with four vanes 22 but the number of vanes 22 may be designed to be selected as three or other numbers depending on the type or the operation characteristics of the engine.

Further, the exemplary form of the present disclosure describes that the vane 22A provided with the locking pin member 40 is one but the rotor 20 may also be provided with the two vanes 22A each provided with the locking pin members 40.

Figure 4:
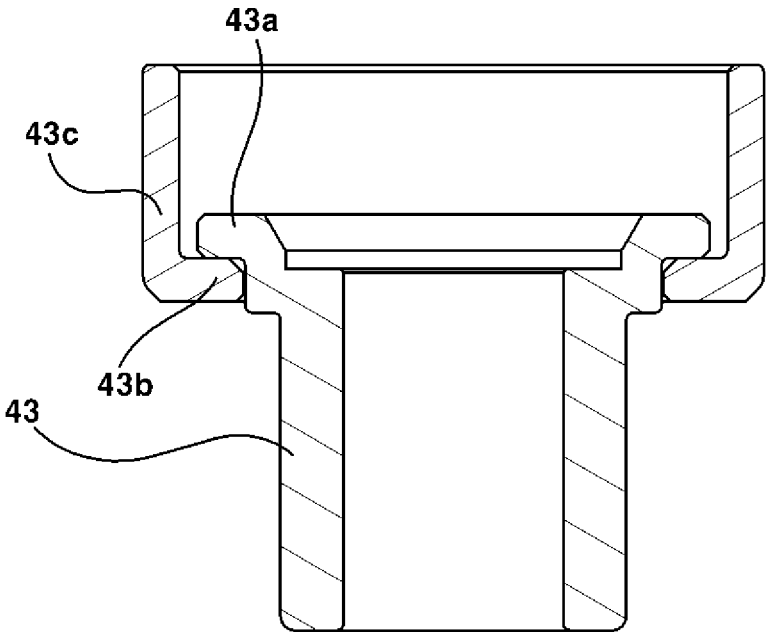
FIG. 4 is a cross-sectional view illustrating a structure of an outer pin of a locking pin member.

Meanwhile, as illustrated in FIG. 4, the outer pin 43 may be changed to the structure in which the outer circumferential portion of the upper portion thereof is divided into a step-shaped extension 43*a* and a cylindrical part 43*c* having a flange part 43*b* coupled with the lower edge of the extension 43*a*, thereby solving the case in which an accumulated tolerance of the components is concentrated on the outer circumferential surface of the outer pin 43 slid while adhering to the inner circumferential surface of the mounting hole 25.

In another form, the drain groove of the ratchet plate and the drain hole of the rotor may perform the blocking function when performing the phase adjustment operation of the locking pin member and discharge the working fluid of the locking groove by communicating with each other at the time of the locking to smoothly and certainly perform the locking operation of the locking pin member, thereby improving the reliability and making the structure simple to reduce the design burden and the manufacturing costs.

Therefore, it should be understood that the above-mentioned forms are not restrictive but are exemplary in all aspects. It is to be understood that the scope of the present disclosure will be defined by the claims rather than the above-mentioned description and all modifications and alternations derived from the claims and their equivalents are included in the scope of the present disclosure.

What is claimed is:

1. A valve timing adjusting device between a crank shaft and a cam shaft of an internal combustion engine, the valve timing adjusting device comprising:

a housing coupled with a ratchet plate interlocking with the crank shaft and having an inner space;

a rotor configured to partition the inner space of the housing into an advance chamber and a retard chamber while interlocking with the cam shaft, the rotor having a plurality of vanes relatively rotating in the advance chamber and the retard chamber with respect to the housing by a pressure of a working fluid to adjust a phase; and a rotation preventing means configured to suppress a position change between the rotor and the housing by regulating the relative rotation of the rotor with respect to the housing, wherein the rotation preventing means includes:

a locking pin member elastically installed in a mounting hole of at least one of the plurality of vanes;

a plurality of locking grooves connected to each other at different depth on a surface of the ratchet plate so that the plurality of locking grooves are coupled with the locking pin member during a locking operation of the locking pin member;

a drain groove connected to at least one locking groove of the plurality of locking grooves and configured to discharge the working fluid within the at least one locking groove during the locking operation; and a drain hole formed in the rotor and configured to communicate with the drain groove, and wherein the drain groove includes a first drain groove extending in a radial direction of the rotor and a second drain groove extending in a circumferential direction of the rotor and being connected to the first drain groove, the second drain groove configured to be selectively blocked from or communicate with the drain hole.

2. The valve timing adjusting device of claim 1, wherein the locking pin member further includes an upper cap configured to close one end portion of the mounting hole.

3. The valve timing adjusting device of claim 2, wherein the locking pin member includes an outer pin elastically installed against the upper cap, and an inner pin elastically installed in the outer pin against the upper cap.

4. The valve timing adjusting device of claim 3, wherein the outer pin has a structure in which an outer circumferential portion of an upper portion thereof is divided into a step-shaped extension and a cylindrical part having a flange part coupled with a lower edge of the step-shaped extension.

5. The valve timing adjusting device of claim 2, wherein the locking pin member further includes a lower cap configured to support an outer circumferential surface of an outer pin, the lower cap positioned at another end portion of the mounting hole.

6. The valve timing adjusting device of claim 1, wherein the drain hole is positioned to be adjacent to an inner circumferential surface of the housing at an outside of the mounting hole of the at least one of the plurality of vanes.

7. The valve timing adjusting device of claim 1, wherein the first and second drain grooves are positioned to be biased in an advance direction with respect to a central line of the at least one locking groove of the plurality of locking grooves.

* * * * *